US007402818B2

(12) United States Patent
Forsyth et al.

(10) Patent No.: US 7,402,818 B2
(45) **Date of Patent: *Jul. 22, 2008**

(54) TACTICAL INTEGRATED ILLUMINATION COUNTERMEASURE SYSTEM

(75) Inventors: John L. Forsyth, Greenfield, NH (US); Albin A. Hastbacka, Amherst, NH (US); Dean A. Coe, Peterborough, NH (US); David C. Kring, North Kingstown, RI (US); Neal E. Fine, North Kingstown, RI (US)

(73) Assignee: Flight Safety Technologies, Inc, Mystic, CT (US)

( * ) Notice: Subject to any disclaimer, the term of this patent is extended or adjusted under 35 U.S.C. 154(b) by 158 days.

This patent is subject to a terminal disclaimer.

(21) Appl. No.: 11/232,482

(22) Filed: Sep. 21, 2005

(65) Prior Publication Data

US 2008/0142734 A1 Jun. 19, 2008

Related U.S. Application Data

(60) Provisional application No. 60/649,709, filed on Feb. 2, 2005.

(51) Int. Cl.
*G02B 6/43* (2006.01)

(52) U.S. Cl. ..... 250/492.1; 250/504 R; 324/14; 362/470

(58) Field of Classification Search ..... 250/492.1
See application file for complete search history.

(56) References Cited

U.S. PATENT DOCUMENTS

| | | | | |
|---|---|---|---|---|
| 4,990,920 | A | 2/1991 | Sanders, Jr. | |
| 5,703,314 | A * | 12/1997 | Meeker | 89/1.11 |
| 6,420,720 | B1 * | 7/2002 | Rubin | 250/504 R |
| 6,825,791 | B2 | 11/2004 | Sanders et al. | |

* cited by examiner

*Primary Examiner*—David A. Vanore
*Assistant Examiner*—Phillip A. Johnston
(74) *Attorney, Agent, or Firm*—Nicole E. Coppes-Gathy

(57) ABSTRACT

A method for generating visible light and a deceptive signature pattern for an emissions producing asset is disclosed. The method comprises illuminating at least one lighting assembly of the asset in a pattern. The pattern produces visible light synchronous with a signature of a wavelength in a substantially similar range as normal emissions of the asset. The method also comprises modulating a radiant intensity of the signature of the at least one lighting assembly between a minimum radiant intensity and a maximum radiant intensity in a repetitive cycle and operating a controller to regulate the pattern.

29 Claims, 6 Drawing Sheets

| | 1 | 2 | 4 | 5 | 6 | 7 | 9 | 10 | 11 | 12 | 14 | 15 | 16 | 17 | 19 | 20 | 21 | 22 | 24 | 25 |
|---|---|---|---|---|---|---|---|---|---|---|---|---|---|---|---|---|---|---|---|---|
| Series1 | 6 | 5 | 3 | 2 | 1 | 0 | 0 | 0 | 0 | 0 | 0 | 0 | 0 | 0 | 0 | 0 | 0 | 0 | 0 | 0 |
| Series2 | 0 | 1 | 3 | 4 | 5 | 6 | 4 | 3 | 2 | 1 | 0 | 0 | 0 | 0 | 0 | 0 | 0 | 0 | 0 | 0 |
| Series3 | 0 | 0 | 0 | 0 | 0 | 0 | 2 | 3 | 4 | 5 | 5 | 4 | 3 | 2 | 0 | 0 | 0 | 0 | 0 | 0 |
| Series4 | 0 | 0 | 0 | 0 | 0 | 0 | 0 | 0 | 0 | 0 | 1 | 2 | 3 | 4 | 6 | 5 | 4 | 3 | 1 | 0 |
| Series5 | 0 | 0 | 0 | 0 | 0 | 0 | 0 | 0 | 0 | 0 | 0 | 0 | 0 | 0 | 0 | 1 | 2 | 3 | 5 | 6 |

TACTICAL INTEGRATED ILLUMINATION COUNTERMEASURE SYSTEM

PRIORITY STATEMENT

This application claims priority to U.S. Provisional Application No. 60/649,709, entitled "Spatial Infrared Countermeasure System" filed on Feb. 2, 2005, the disclosure of which is incorporated herein by reference in its entirety.

BACKGROUND

An increasing threat to commercial aircraft is the availability of portable surface to air missiles. It is estimated that there are more than 200,000 unfired SA-7 Missiles in the world today. There are more than several hundred unfired U.S.-made Stingers remaining from the Soviet-Afghan war, which are more accurate than the SA-7s. The SA-7 and Stinger missiles are shoulder launched and are effective up to an altitude of 20,000 feet. They can be fired from the ground, from rooftops, boats, and vehicles anywhere in the landing or takeoff pattern of an aircraft.

The SA-7 and Stingers incorporate an infrared (IR) radiation guidance system that "sees" (or senses) the IR radiation signature (or pattern) of the target aircraft. The hot metal surfaces on a jet engine (or turbo-prop engine), and associated hot gas plume, are typically the major contributors of the radiation signature. Once a radiation signature is placed within its field of view and the missile guidance system is initiated, it locks onto the radiation signature and communicates guidance instructions to the missile flight control system. Well-developed algorithms in the guidance systems provide a continuously updated lead angle for the missile trajectory based on sensed changes in direction and rate of the changes in the relative position of the target aircraft, or more precisely, its radiation signature.

IR radiation countermeasure systems for aircraft have been developed to thwart these types of seeker missiles and other types of threat vehicles. Generally, an IR countermeasure system works by first detecting a missile launch, then initiating a spurious radiation signature substantially more intense than that produced by the aircraft's engines, from a location displaced from the aircraft. The source of the spurious radiation is typically ejected (or otherwise physically removed or displaced) from the immediate vicinity of the host aircraft (e.g., firing flares or towing a decoy). Thus, the IR guided missile is attracted towards the source of the spurious radiation signature, away from the target aircraft.

Flares used in such systems typically have as much as twenty (or more) times higher intensity than the emissions that are being masked (i.e., the IR signature from the aircraft). Unfortunately, some missiles (or other threat vehicles) are programmed to detect and reject a radiation signature having a large difference in intensity.

One available countermeasure system uses a missile launch detector, detecting the missile exhaust plume, and directional IR sources (or lasers). This type of countermeasure system is very expensive (i.e., between two and three million dollars). Another countermeasure system employs an onboard transmitter in conjunction with the threat detection and identification system to send a command signal directly to the incoming missile to redirect it. This "electric brick" or "hot brick" type system modulates an electrical (or fuel heated) IR source to spoil the aim of the IR missile.

Another countermeasure system is disclosed in U.S. Pat. No. 4,990,920 (hereinafter "the '920 patent") to Royden C. Sanders, Jr. The '920 patent disclosed a missile detection system and a RF transponder onboard an aircraft and a towed decoy to separate the transponder. The system has been used with a decoy towed at 300 feet behind the aircraft. The system has induced missile misses of 150-feet behind the towed decoy, protecting both the host aircraft and the towed decoy.

Another countermeasure system is disclosed in U.S. Pat. No. 6,825,791 (hereafter "the '791 patent") to Sanders et al. The '791 patent discloses a deceptive signature broadcast system for an aircraft (or other emissions generating asset). The system generates an emissions pattern that masks the normal emissions signature of the aircraft or asset. The system protects it from emissions tracking intercept vehicles, such as IR tracking missiles. The system includes at least two beacons mounted in a spaced apart arrangement orthogonal to the desired zone of protection, and bracketing the asset, such as on opposite wingtips of the aircraft for fore and aft protection. The beacon set is modulated from one end to the other with a sweeping pattern of emission intensity, deceptively indicating to the intercepting vehicle a lateral component of motion of the aircraft away from its true relative position within the intercept vehicle's field of view, thereby inducing the intercept vehicle to adopt an erroneous and exaggerated lead angle and course correction that results in a missed intercept trajectory. Unfortunately, the '791 patent requires many expensive additional components for providing the synchronized, multi-source radiation broadcast system.

Visual detection and recognition of an approaching hazard by means of warning signals, such as external alerting lights, play a major role in avoiding collisions between transportation vehicles. The United States Department of Transportation (DOT) requires two lighting systems for certain mass transportation vehicles; an "aid to navigation" lighting system and an "anti-collision" lighting system. "Aid to navigation" lighting systems consist of steady burn lights and landing lights, including red, green, and white position lights See 14 CFR Part 25, subparts 25.1383-1395 for specific requirements. "Anti-collision" lighting systems consist of flashing lights to illuminate the vital areas around the airplane. The system of flashing lights must give an effective flash frequency of not less than 40 cycles per minute (cpm) and nor more than 100 cpm. See 14 CFR Part 25, Subpart 25.1401.

The FAA procedures require that an "anti-collision" lighting system be operated during take off and landing to make the aircraft visible to other aircraft and to those on the ground. The existing lighting systems on aircraft emit visible light to meet the requirements of the FAA. Current sources utilized in countermeasure systems allow only for IR to be emitted. As is well understood in the art, jet engine IR signatures of the engine metal at the inlet, or outlet, fall generally in the region of Band 1 (i.e., about 1.8 microns to about 2.8 microns), which is the reason that threat missile guidance systems operate in this region. However, the jet engine plume is of greatest intensity in the region of Band 4 (i.e., about 3.8 microns to about 5 microns), and some guidance systems utilize a Band 4 or a dual-band sensor system to provide for greater reliability of the tracking system. Unfortunately, current countermeasure system sources do not pass a significant percentage of the Band 4 spectra.

Existing countermeasure systems require the deceptive (or jammer) emissions from a countermeasure system to have greater power than the host asset's inherent emission signature. These deceptive emissions require a large amount of power in order to draw the missile away from the host asset. This requirement often renders the prior art countermeasure systems impractical and expensive.

What is needed in the art is a low-cost, low-power solution that utilizes existing components of an aircraft (or asset) with a specialized lighting assembly, which emits both visible light and IR in the appropriate ranges, so as to integrate a missile countermeasure system based on a synchronized, multi-source radiation broadcast system with visible lighting procedures.

SUMMARY

The present disclosure teaches a method for generating visible light and a deceptive signature pattern for an emissions producing asset is disclosed. The method comprises illuminating at least one lighting assembly of the asset in a pattern. The pattern produces visible light synchronous with a signature of a wavelength in a substantially similar range as normal emissions of the asset. The method also comprises modulating a radiant intensity of the signature of the at least one lighting assembly between a minimum radiant intensity and a maximum radiant intensity in a repetitive cycle and operating a controller to regulate the pattern.

The present disclosure also discloses the maximum radiant intensity is greater than a normal radiant intensity of the asset and the minimum radiant intensity is at least equal to the normal radiant intensity of the asset. Also, a range of the radiant intensity of the signature is about 0.1 to about 0.9 times a radiant intensity of the asset. Further, a centroid of the radiant intensity of the signature and a radiant intensity of the asset during each the repetitive cycle moves uniformly from a first of the lighting assembly to a last of the lighting assembly.

The present disclosure also discloses that the modulating of the radiant intensity comprises modulating the radiant intensity of a first of the lighting assembly from the maximum radiant intensity to the minimum radiant intensity and concurrently modulating the radiant intensity of a next adjacent lighting assembly from the minimum radiant intensity to the maximum radiant intensity. Also, the asset is selected from the group consisting of an airborne vehicle, a space vehicle, a landborne vehicle, a waterborne vehicle, an amphibious vehicle, and a stationary asset. Further, the wavelength comprises wavelengths within ultraviolet range through long wave infrared range.

The present disclosure also discloses that the repetitive cycle comprises a modulation time of about 0.1 to about 3 seconds. And the repetitive cycle comprises a period of the maximum radiant intensity followed by a period of a lower radiant intensity followed by a snapback to the maximum radiant intensity. A time of the snap back is about 1 millisecond to about 200 milliseconds.

The present disclosure also discloses that the lighting assembly is disposed on at least one of a wing tip, a tail tip, a belly, and a nose of the asset. The lighting assembly has more than one illumination source.

The present disclosure also discloses operating an onboard missile detection system in conjunction with the lighting assembly. Also, the illuminating of the lighting assembly is automatically activated when a missile is detected within about 100 feet to about 20,000 feet of the asset. Further, the illuminating of the lighting assembly is automatically activated when an altimeter of the asset decreases below about 15,000 feet to about 20,000 feet.

A system for altering the radiation signature pattern of an emissions producing asset is also disclosed. The system comprises a lighting system having at least one lighting assembly. The lighting assembly illuminates in a pattern to produce visible light synchronous with a signature of a wavelength in substantially the similar range as normal emissions of the asset. The system also comprises a modulation means to modulate a radiant intensity of the signature of the at least one lighting assembly between a minimum radiant intensity and a maximum radiant intensity in a repetitive cycle and a controller to operate the at least one lighting assembly in the pattern.

A method for generating visible light and a deceptive signature pattern for an emissions producing asset is also disclosed. The method comprises illuminating a lighting assembly of the asset in a pattern, in which the lighting assembly produces visible light synchronous with a signature of a wavelength in a substantially similar range as normal emissions of the asset. The method also comprises modulating a radiant intensity of the signature of the lighting assembly between a minimum radiant intensity and a maximum radiant intensity in a repetitive cycle to create the pattern. The radiant intensity of the signature is about 0.1 to about 0.9 times a normal radiant intensity of the asset. The method also discloses operating a controller to regulate the pattern.

BRIEF DESCRIPTION OF FIGURES

Referring now to the figures, wherein like elements are numbered alike.

DETAILED DESCRIPTION

Figure 1:
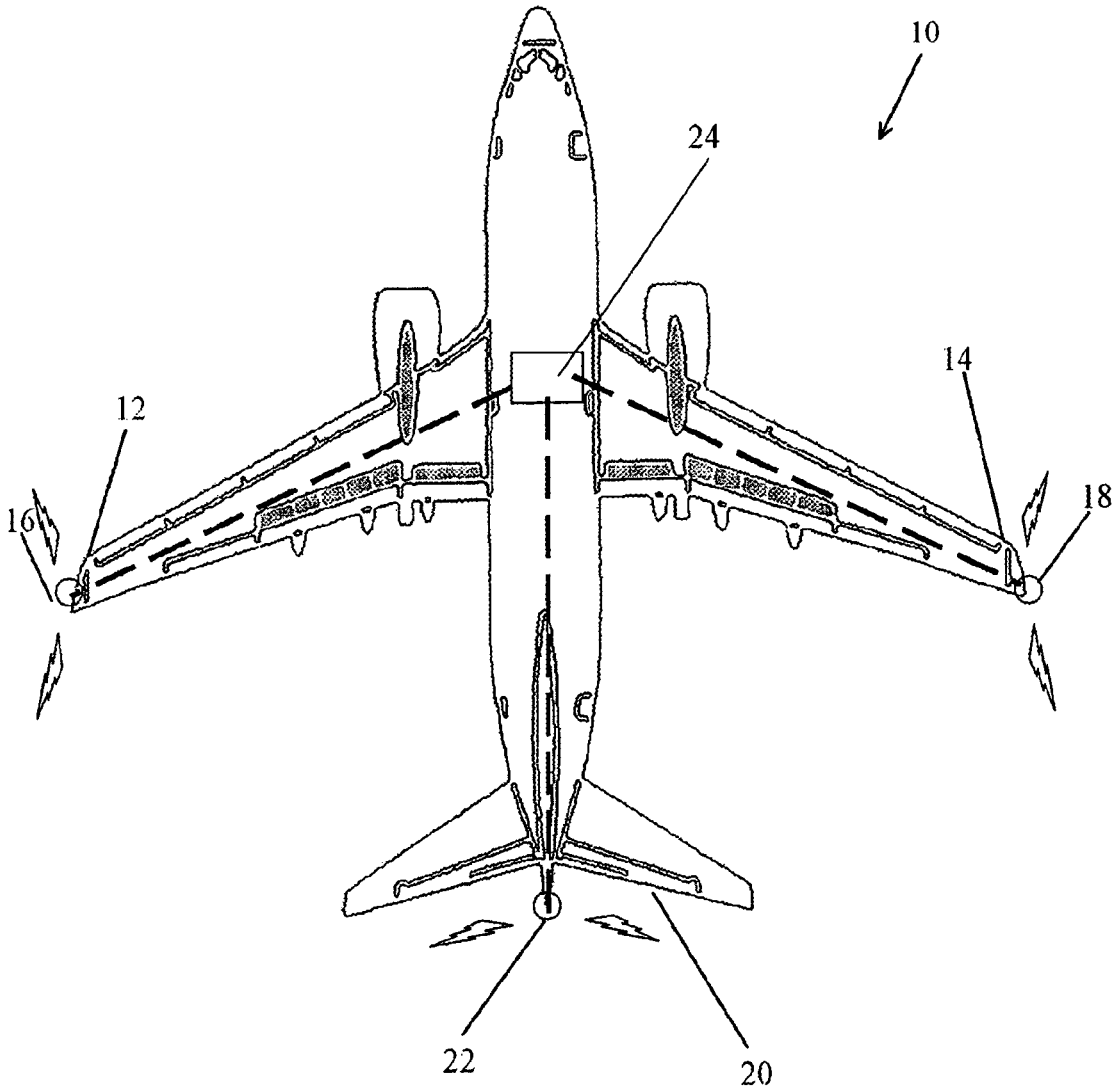
FIG. 1 is a top view of an aircraft incorporating the tactical integrated illumination countermeasure system.

Persons of ordinary skill in the art will realize that the following disclosure is illustrative only and not in any way limiting. Other embodiments of the invention will readily suggest themselves to such skilled persons having the benefit of this disclosure.

In a preferred embodiment, the present invention comprises utilizing a specialized lighting source (or light assembly or beacon) in the existing lighting system on each wingtip, and preferably the tail, belly, and nose, of an aircraft. This source emits light, both in the visible range and in the infrared range, thus providing a means of utilizing the existing lighting system as required by the FAA for take off and landing procedures, as well as an effective countermeasure.

For the take off and landing procedures, the FAA requires a pattern of visible light (i.e., blinking in a random pattern) that provides a visible indicator of the presence of the aircraft. For this present invention, this pattern of visible light can be synchronized into a pattern that is compatible with the countermeasure system, such that the same specialized source is utilized to emit visible light and IR radiation simultaneously. The pattern for the countermeasure use is adapted to be in the range required for the FAA regulations. Thus, the pattern emits visible light synchronously with the IR radiation emissions (i.e., from the same beacon) to act as a visible presence indicator as well as a countermeasure system. The specialized source allows for the visible light and the IR to be emitted at the same time, in any appropriated band range, including Band 1 and Band 4. In an alternative embodiment, more than one illumination source (or bulb) disposed in the lighting assembly may be utilized to emit visible light and IR radiation in a synchronized pattern.

For the countermeasure embodiment, the specialized source can be utilized to provide synchronized patterns of IR radiation emission, at appropriate cycle times, of high and low level intensities of radiation at the period of interest in the normally emitted radiation signature; high level intensity being greater than the normal radiation signature intensity of the aircraft. The period of the pattern (or flashing) of visible light/IR from side to side (e.g., left to right or right to left or randomly within appropriate times or "sweep" time) can be about 3.0 seconds to about 0.1 second.

Using this sweep-modulated broadcast technique, an exaggerated zigzag pattern of intercept is induced, whereby an incoming missile is attracted to the first (or lead-off) beacon, then swept to the other (or trailing) beacon by the shifting center of intensity so as to erroneously interpret a lateral motion (or displacement) of the aircraft that in turn induces an erroneous and excessive lead angle at each zig; then zagging back to the lead off beacon when the broadcast cycle starts anew. When the missile closes in on the aircraft such that the lead off beacon falls out of the missile's field of view, the missile continues on its last erroneous lead angle, by which time it is likely too late to make a useful correction and the intercept fails.

More particularly, the present invention also includes a snapback (or reset) time at the end of the modulation cycle for resetting all beacons in the set to their respective initial high and low power settings. A snapback time is sufficiently short so that it has no significance to the missile response time or to the proportional navigation guidance system response time. The snapback time can be about 10% of the sweep time, a preferable time is about 1 millisecond to about 200 milliseconds, with about 10 milliseconds to about 150 milliseconds preferred. When this pattern of sweep modulation and snap back is repeated in synchronous fashion by the set of beacons, the deceptive signature indicating an apparent movement in the selected direction causes the missile to make an oscillating, or zigzag-like, approach. The missile makes a long "zig" for the duration of the sweep cycle to follow the deceptive signature sweep, and builds in a correcting lead angle that would lead to a missed-intercept trajectory by the guidance system. At the point that the sweep cycle ends and the snapback occurs, if the first beacon remains within the field of view of the seeker, the seeker may "see" the first beacon restart and begins a reversing "zag"; a correction back towards the first beacon within the limits of its response time. The attempted course reversal or "zag" is of short duration, however, as the sweep modulation immediately induces another reversing "zig" in the direction of the signature sweep, with its longer duration, again inducing an erroneous correcting lead angle in the direction of the signature sweep. Eventually, when the missile is close enough, the originating or ramp down beacon, or beacons, fall out of the field of view. Thereupon, the missile continues on its last erroneous lead angle, taking it outboard of the last or most outboard beacon and wingtip, resulting in a missed intercept.

Vulnerability to man-portable and shoulder-fired radiation seeking missiles is highest during take-off and landing operations, from the ground surface up to an altitude of about 20,000 feet. Missile launchers prefer to have a head-on or tail view of the aircraft engines where the IR radiation signatures are strongest, and where acquisition and firing tones will be emitted as a lock-on signal before firing. The immediate vicinity of runways and airports is generally protected against unauthorized access, but the zone of vulnerability to a surface based missile launch from ahead of or behind the aircraft extends some distance out beneath the take off and landing zones. For the best fore and aft zones of protection, a wingtip to wingtip design encompassing a tail and nose beacon is the basic configuration of choice. Of course other configurations are within the scope of the invention, depending on factors such as the aircraft size and configuration, the normally emitted radiation signature pattern and intensity of the aircraft, the desired zones of protection, and the type and performance characteristics of the threat vehicle. A preferred embodiment includes utilizing beacons at both wingtips, the nose, the tail, and a central location at the belly of the aircraft. In this preferred embodiment, the aircraft would have countermeasure coverage over all missile approach zones.

As will be further appreciated by those skilled in the field, significant high intensity radiation at other than IR radiation wavelengths may be detectable on or emitted from various possible sources on an aircraft. Recognizing that multi-band sensors are not uncommon and may be expanded or revised to target other peak intensity wavelengths of the aircraft's total radiation signature, the present invention contemplates the use of single, dual and multi-band beacon systems that emit deceptive patterns of radiation in any mix of wavelengths from visible to ultraviolet through long wave infrared inclusively, at which guidance systems may be known or developed to detect and track. The bands or wavelengths may be switchable or selectable in some beacons and some system configurations, to address different threats at different times and places.

Referring now to FIG. 1, a top view of an aircraft 10 is shown. On each wingtip 12, 14 of the aircraft 10 is the standard beacon (or lighting assembly or emitter) 16, 18. On the tail tip 20, another standard beacon 22 is disposed. During take off and landing procedures, these beacons 16, 18, and 22 are illuminated in a pattern to provide a visible indicator of the presence of the aircraft 10, as required by the FAA. Depending upon the size of the aircraft (or asset or body), other beacons (not shown) may be installed to provide adequate countermeasure sequencing.

A control system (or controller) 24 is electrically coupled to the existing lighting system of the aircraft 10 to provide for the appropriate sequencing of the IR radiation signals (with the visible light) for masking the actual position of the aircraft 10 from missiles equipped with IR radiation guidance systems. The system 24 can be adaptable to different types of aircraft by utilizing appropriate hardware and/or appropriate software. The system 24 can be operated both manually (i.e., physically turning on the system) or automatically (i.e., responding to an altimeter or other sensor).

Each beacon 16, 18 and 22 is adapted to provide for both visible and infrared emissions. In order to operate the beacon incorporating the countermeasure system, the beacon must be adapted to emit both visible light and IR radiation in the ranges required. These beacons may have one illumination source or several illumination sources. Any illumination sources may be used, including sources able to emit light in the visible, IR and ultraviolet light ranges. Several examples of illumination sources include, but are not limited to, incandescent and other filament based sources, fluorescent and other gas discharge sources, plasma discharge sources, compact short or long plasma arc lamps, IR heat lamps, lasers, light emitting diodes, and combinations thereof.

It is contemplated that a low voltage or a narrow pulse width modulated voltage can be supplied to the emitter to prevent degradation over time. This low voltage will keep the filament "warm" and serve to prevent failure of the filament from a cold startup.

It is contemplated that an anti-reflective coating, for controlling the relative amplitude of Band 1 and Band 4 output, may be utilized in order to minimize the output of visible light from the bulb. An anti-reflective coating can be applied to both the inner and outer surfaces of the bulb. The anti-reflective coating can also be applied to the inner and outer surfaces of the outer shield. The anti-reflective coating can be any material that will block the desired band of radiation, including, but not limited to, silicon dioxide, tantalum oxide, titanium dioxide, magnesium fluoride, calcium fluoride, and zinc selenide. The anti-reflective coating may also be specially selected to block a specific band. This embodiment may be particularly useful for military aircraft and vehicles.

In preferred embodiments for the countermeasure use, the low or threshold level intensity of a beacon is about 0.1 times normal emissions of the aircraft so as to remain visible to the threat vehicle as compared to the normal aircraft emissions intensity, and full intensity is not less than about 10 times normal aircraft emissions intensity. In a preferred embodiment, the radiant intensity of the beacon is about 0.05 times to about 2.0 times the normal emissions of the aircraft, with a preferred radiant intensity of about 0.1 times to about 0.9 times the normal emissions of the aircraft. Although a lower differential between the normal and the low or threshold beacon intensity, and/or a full beacon intensity of less than twice normal aircraft emissions intensity, may still be effective for confounding some threat vehicles.

A weatherproof envelope (or shield or outer shield) (not shown) made of material substantially transparent to the emissions of interest, may be required to protect the functional components of the beacons from exposure to the elements. Several materials contemplated include sapphire, aluminum oxide, polycrystalline alumina, barium fluoride, calcium fluoride, silica, fused silica, magnesium fluoride, zinc sulfide, silicon, and the like.

For military vehicles, it may be desirable to have an embodiment in which the visible light is controlled such that it is only visible when the pilot desires. One example is a moveable shield that can be utilized to block the visible light in various situations. In the alternative, a dual switch light, similar to an automotive tail light with a turn signal function, or separate IR and visible light sources, can be utilized to emit visible light only when desired.

Alternative embodiments may include additional lighting assemblies mounted on the aircraft in locations not equipped with existing beacons. Other areas of the aircraft, such as the wing, tail, and/or nose, allow for different or additional fields of emission.

Figure 2:
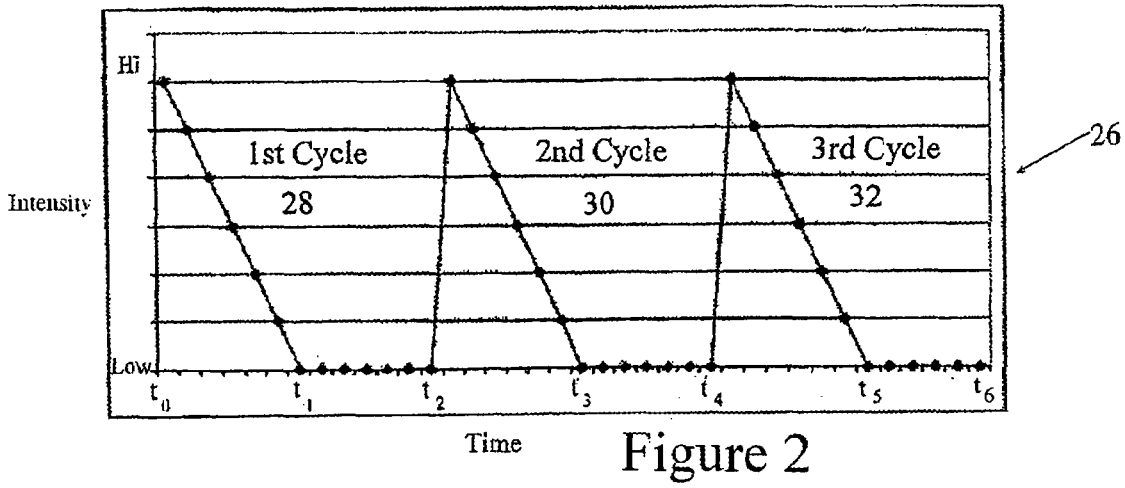
FIG. 2 is a graph of the intensities of IR radiation being emitted from the left wingtip lighting assembly over time.
Figure 3:
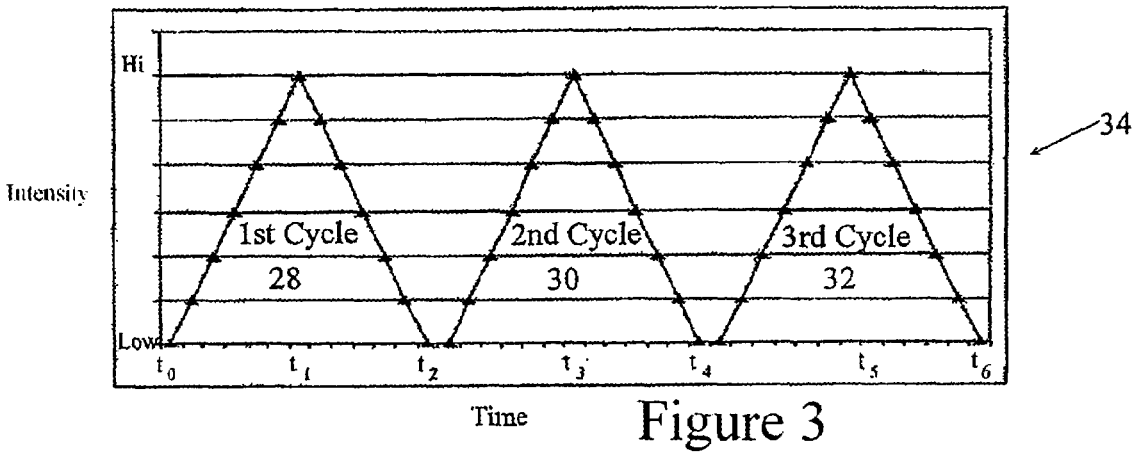
FIG. 3 is a graph of the intensities of IR radiation being emitted from the tail tip lighting assembly over time.
Figure 4:
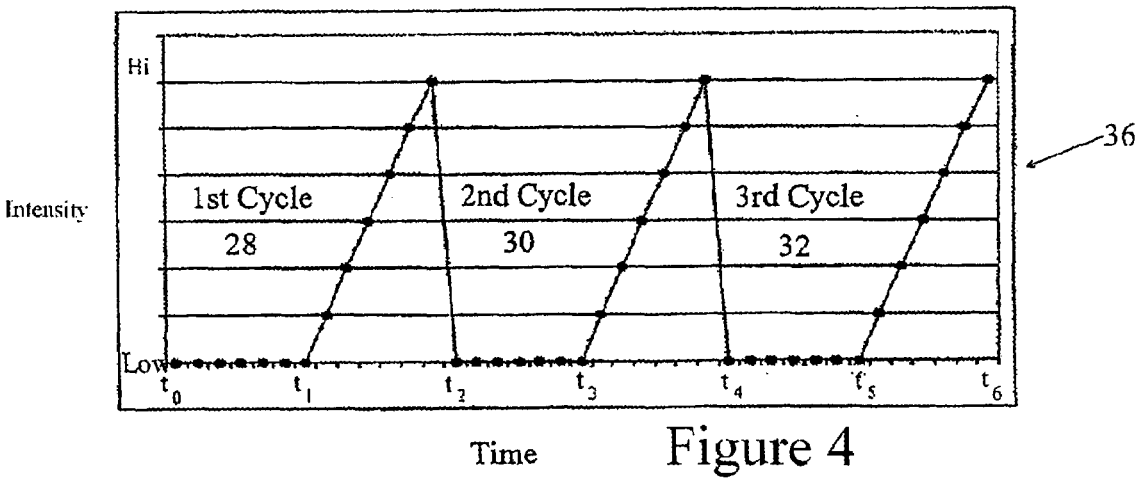
FIG. 4 is a graph of the intensities of IR radiation being emitted from the right wingtip lighting assembly over time.

Referring to FIGS. 2, 3, and 4, graphs of the intensities of the IR radiation intensity of the left wingtip beacon 16 (Graph 26), right wingtip beacon 18 (Graph 36), and tail tip beacon 22 (Graph 34) over time is illustrated. The view would be, for example, from aft of the aircraft by a missile with all beacons within its field of view. The IR radiation emissions are operated in a serial sequence of changing intensities that results in a deception of signature pattern. In the first half of cycle 28, from $t_0$ to $t_1$, left wingtip beacon 16 begins at high intensity (i.e., Hi) and then ramps down (i.e., decreases in intensity) while tail tip beacon 22 ramps up from low intensity, and right wingtip beacon 18 remains at low intensity. In the second half of cycle 28, from $t_1$ to $t_2$, left wingtip beacon 16 remains at low intensity while tail tip beacon 22 ramps down from high intensity to low intensity and right wingtip beacon 18 ramps up from low intensity to high intensity. At time $t_2$, left wingtip beacon 16 snaps back to full intensity (i.e., Hi), and right wingtip beacon 18 snaps back to low intensity. This completes a full modulation cycle, which is then repeated through times $t_3$, $t_4$, $t_5$ and $t_6$ to complete the second cycle 30 and third cycle 32, and can be further repeated in successive cycles. It will be readily apparent that the average radiation intensity of the three beacon system remains substantially uniform, from the perspective of an approaching missile.

Figure 5:
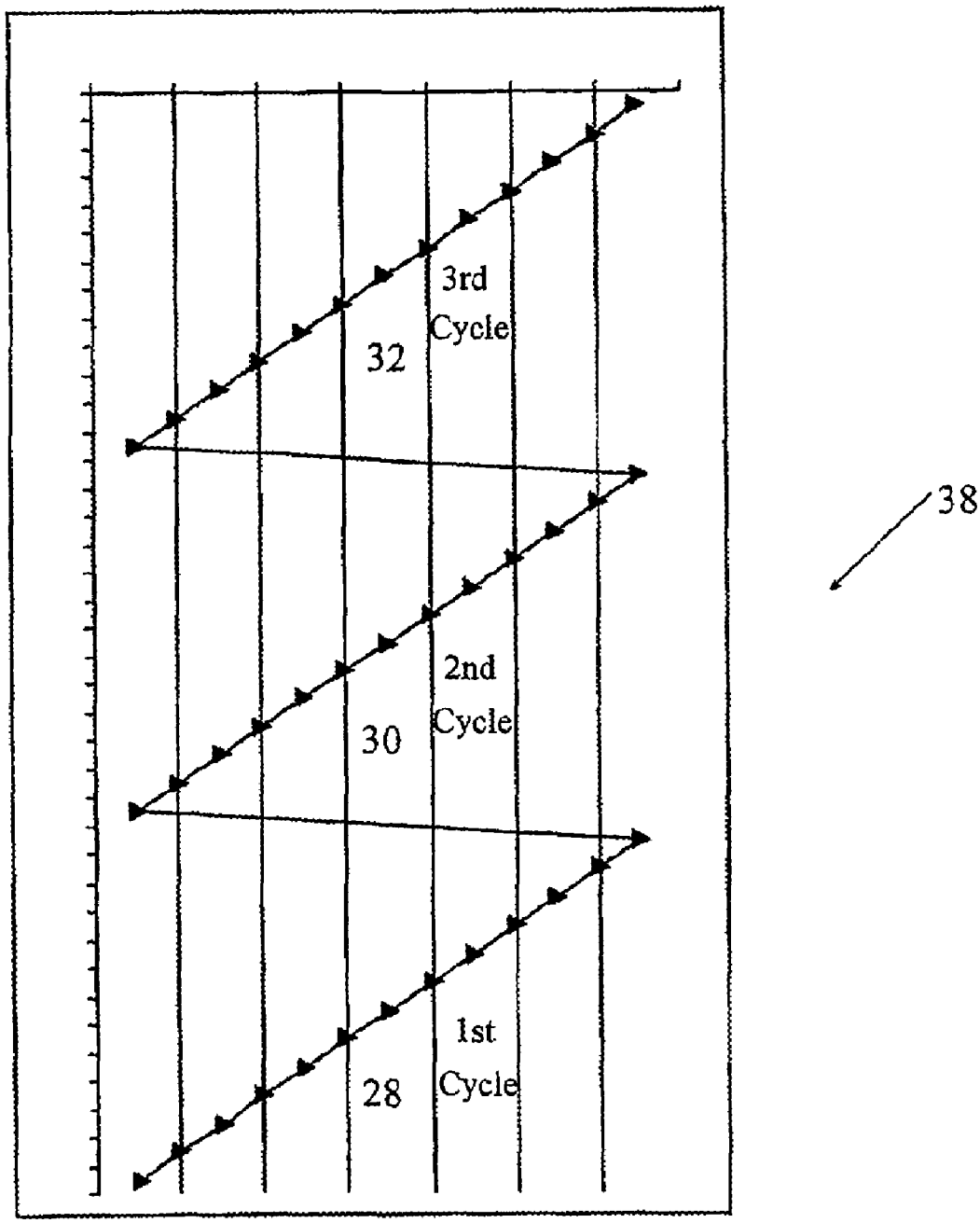
FIG. 5 is a graph of the apparent position of the deceptive signature pattern generated by the waveforms of a three beacon set.

Referring to FIG. 5, the apparent position of the deceptive signature pattern generated by the waveforms of the three beacon set is illustrated in Graph 38. During the first cycle 28, the beacons 16, 18, and 22 create a deceptive signature pattern traveling from left (i.e., starting with left wingtip beacon 16) through center (i.e., tail tip beacon 22) to right (i.e., finishing with right wingtip beacon 18) at a uniform rate over a full cycle (or sweep) of the beacon set. The false pattern is repeated continuously (i.e., as illustrated with second cycle 30 and third cycle 32), creating the zigzag missile trajectory across the full beacon set until the missile sensors are too close to pick up the left wingtip beacon 16. Thereafter, for a short time, the missile guidance system reacts only to tail tip beacon 22 and loses left wingtip beacon 16 from its field of view. The remaining time to target is too short for the next beacon ramp up (i.e., right wingtip beacon 18) to provide a useful correction by the missile, and thus the missile misses the aircraft 10.

For the missile's guidance computer, the effect of each sweep or modulation cycle is a false signature or deceptive indication that the aircraft position is moving from left to right within the missile's field of view, relative to its actual position and flight path. The false signature induces a change of lead angle in the missile's guidance system to the right, ultimately resulting in a missed intercept, typically by about 2 feet to about 200 feet; typically the range is about 10 feet to about 100 feet. Since most surface-to-air IR radiation guided missiles have contact fuses, such a miss distance is acceptable. Other embodiments may employ longer or shorter sweep times and/or snap back times, using mechanical or electronic techniques. In alternative embodiments, the modulation cycle can move from right to left or in a random pattern within appropriate times.

A four or more beacon system may be similarly oriented and operated. While uniform beacon spacing is preferred, some degree of unequal spacing can be tolerated so long as the ramp timing of adjacent beacons is adjusted for the difference, so as to maintain a uniform signature sweep rate across the full set. This concept is illustrated in FIGS. 6 and 7, in which additional beacons may be electrically coupled to the existing beacon system to accommodate large aircraft.

Figure 6:
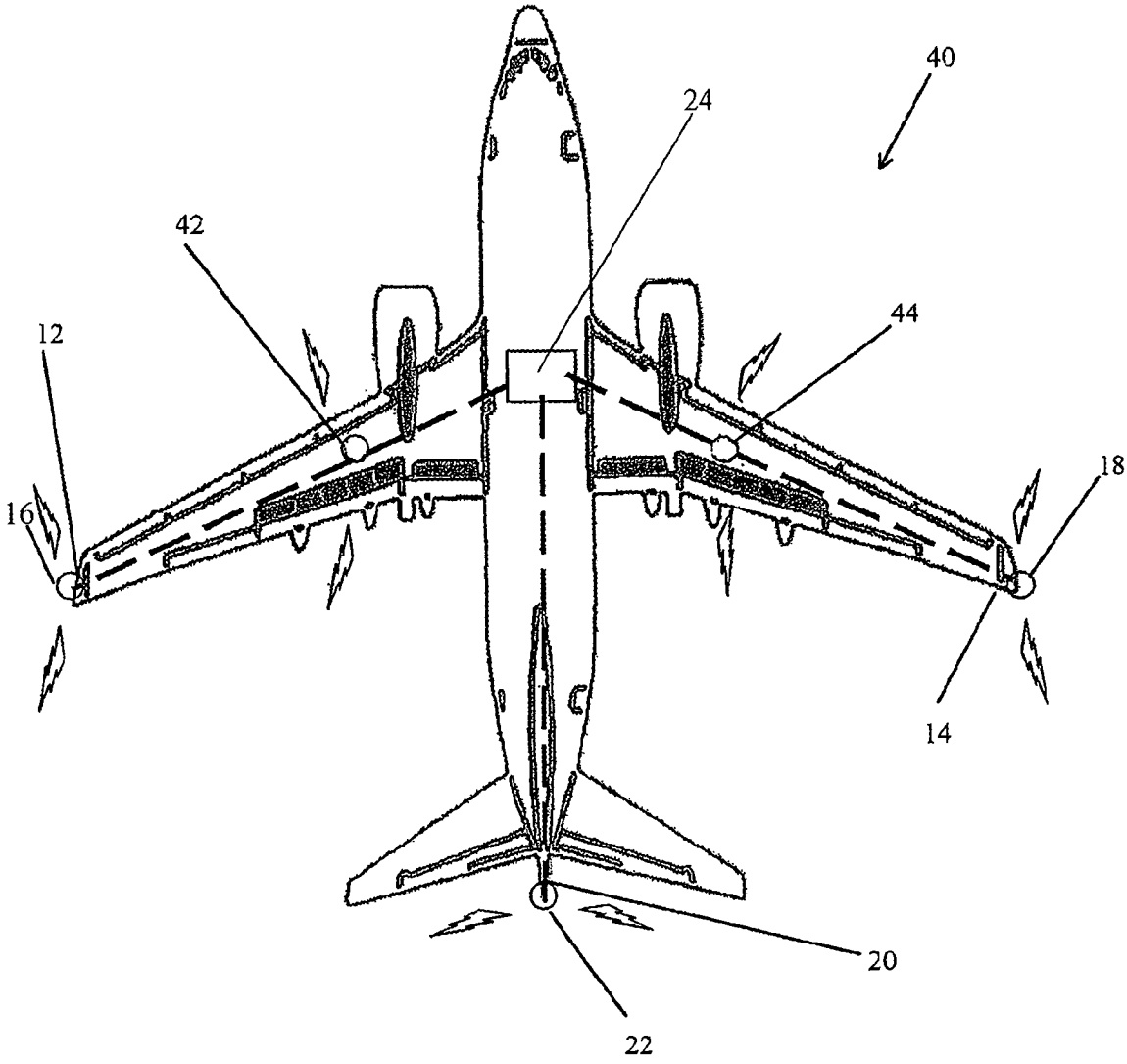
FIG. 6 illustrates a top view of an aircraft incorporating additional lighting assemblies into the tactical integrated illumination countermeasure system.

Referring now to FIG. 6, a top view of a large aircraft 40 is shown. On each wingtip 12, 14 of the aircraft 40 is the standard beacon 16, 18. On the tail tip 20, another standard beacon 22 is disposed. As indicated above, during take off and landing procedures, these beacons 16, 18, and 22 are illuminated in a pattern to provide a visible indicator of the presence of the aircraft 40, as required by the FAA. Additional beacons 42, 44 can be disposed in electrical communication with the aircraft illumination system to be included in the countermeasure sequencing.

As indicated above, the control system 24 is electrically coupled to the lighting system of the aircraft 40 to provide for the appropriate sequencing of the visible signals for anti-collision lighting and the IR radiation signals for masking the actual position of the aircraft 40 from missiles equipped with IR radiation guidance systems. The system 24 can be adaptable to different types of aircraft by utilizing appropriate hardware and/or appropriate software.

Figure 7:
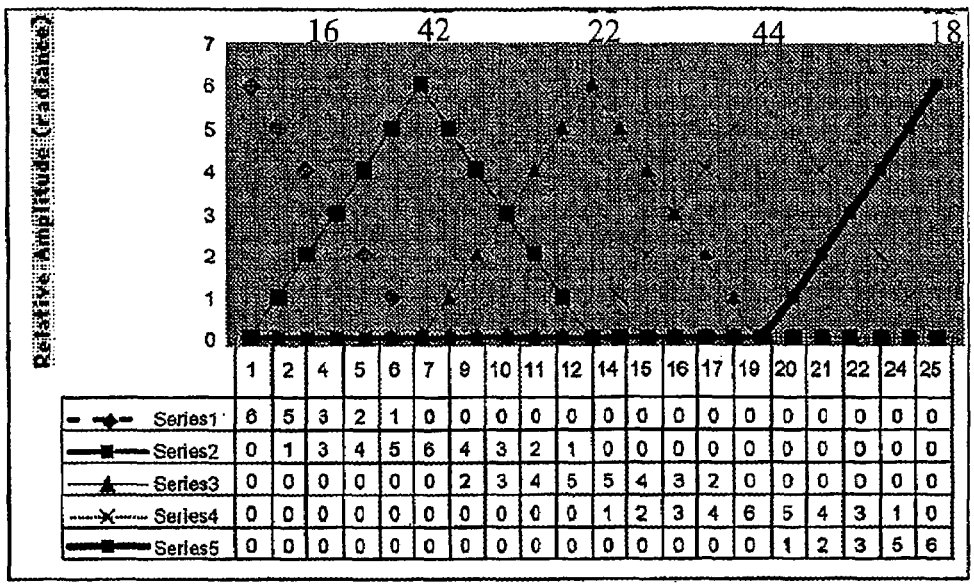
FIG. 7 illustrates additional lighting assemblies that are electrically coupled to the existing lighting assembly system to accommodate large aircraft.

Referring to FIG. 7, the series of beacons 16, 18, 22, 42, and 44 are configured to span a large aircraft (or asset or body) 40. The beacons are relatively closely spaced and operated in sequence, so as to create the desired modulation effect (e.g., as a multi-element sign indicating a lane merge on a highway construction project, or the instrument approach lights on an airport runway that strobe in a repetitive sweep pattern towards the runway threshold). For example, during a first cycle, the beacons 16, 42, 22, 44, and 18 create a deceptive signature pattern traveling from left (i.e., starting with left wingtip beacon 16) to mid-wing (i.e., mid-wingtip beacon 42) through center (i.e., tail tip beacon 22) to mid-wing (i.e., to mid-wingtip beacon 44) to right (i.e., finishing with right wingtip beacon 18) at a uniform rate over a full cycle (or sweep) of the beacon set. The intensity of the beacons is increased to peak intensity and then decreased to create the zigzag pattern. The false pattern is repeated continuously, creating the zigzag missile trajectory across the full beacon set until the missile sensors are too close to pick up the left wingtip beacon 16 and the mid-wing beacon 42. Thereafter, for a short time, the missile guidance system reacts only to tail tip beacon 22 and loses both left wingtip beacon 16 and mid-wing beacon 42 from its field of view. The remaining time to target is too short for the next beacon ramp up (i.e., from mid-wing beacon 44 to right wingtip beacon 18) to provide a useful correction by the missile, and thus the missile misses the aircraft 40. During the course of the cycles, there is a gradual increase and decrease of the intensity of the beacon to create the zigzag effect.

Figure 8:
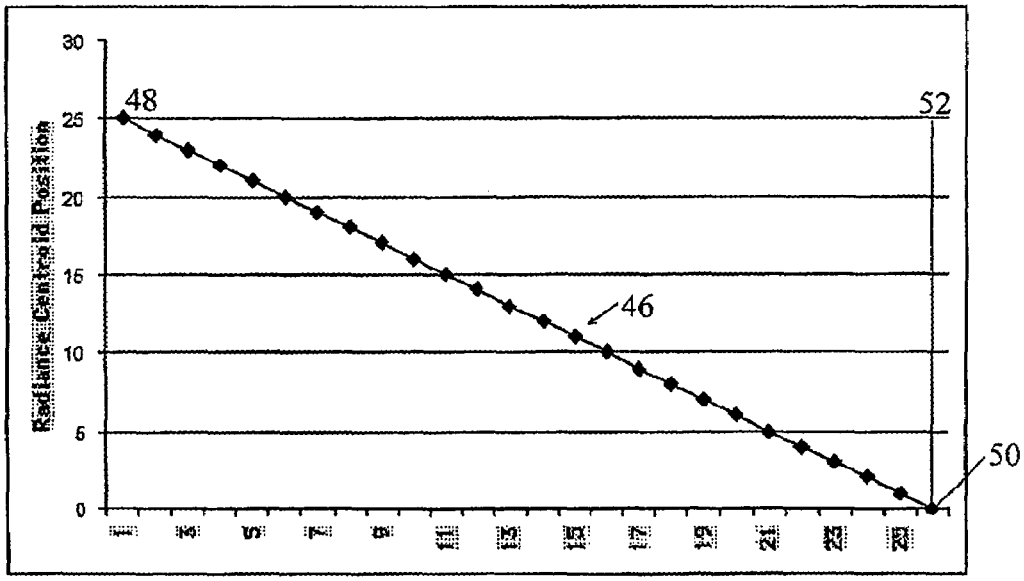
FIG. 8 is a graph illustrating the apparent position of the deceptive signature pattern generated by the waveforms of the five lighting assembly system of FIG. 7.

Referring now to FIG. 8, the apparent position of the deceptive signature pattern 46 generated by the waveforms of the five beacon system of FIGS. 7 and 8 is illustrated. The beacons create a deceptive signature pattern traveling from left 48 to right 50 at a uniform rate over a full cycle (or sweep) of the beacon set. The false pattern is repeated continuously (i.e., the pattern repeats at point 52) creating the zigzag missile trajectory across the full beacon set until the missile sensors are too close to pick up the wingtip beacon. The false pattern repeats itself and the missile is unable to provide a useful correction, and thus the missile misses the aircraft.

When the number of beacons in the span is larger, preferably at least five, and spacing of the beacons is sufficiently small relative to the full span of the beacon set, preferably not more than ⅕ span, the requirement for modulation of each individual beacon may be reduced to a simple synchronized switching to high intensity for a specific time and back to low intensity for a specific time, such that the net effect of all beacons with respect to the seeker is substantially the same as in other embodiments. This may simplify the design and operation of the individual beacons.

Longer and shorter sweep times than the about 0.1 to about 3.0 seconds, with about 0.1 to about 1.5 seconds preferred, may be desirable whether controlled by fixed or variable means, depending on beacon spacing and anticipated defensive requirements. For example, for about a 50 foot beacon span, about a 0.5 second sweep time may be effective. For about a 200 foot span, a longer total time, such as about 1.0 second, may be effective.

As long as at least two modulated IR radiation beacons are within the field of view or beam width of the missile, the missile thinks the aircraft is moving the distance and direction between the two beacons in the sweep time provided, and responds with a correction to its intercept path in the direction of the sweep. By then snapping off the last beacon and restarting the beacon set with a new modulation sweep, the target (or host aircraft) appears to the missile to continue to emit the same deception, inducing a further correction in the same direction to the missile's intercept path until the missed intercept trajectory is probable.

In an alternative embodiment, a one beacon system may be similarly oriented and operated. In this case, only one beacon is operated to create a "walking centroid" effect. The sum of the countermeasure source and the signature from the asset produces an artificial target motion, which misdirects the incoming missile. The centroid is the average position of the signature of the asset and the signature of the countermeasure as seen by the incoming missile. This concept is illustrated in FIG. 9, in which only one beacon is utilized in the existing lighting system of an asset.

Figure 9:
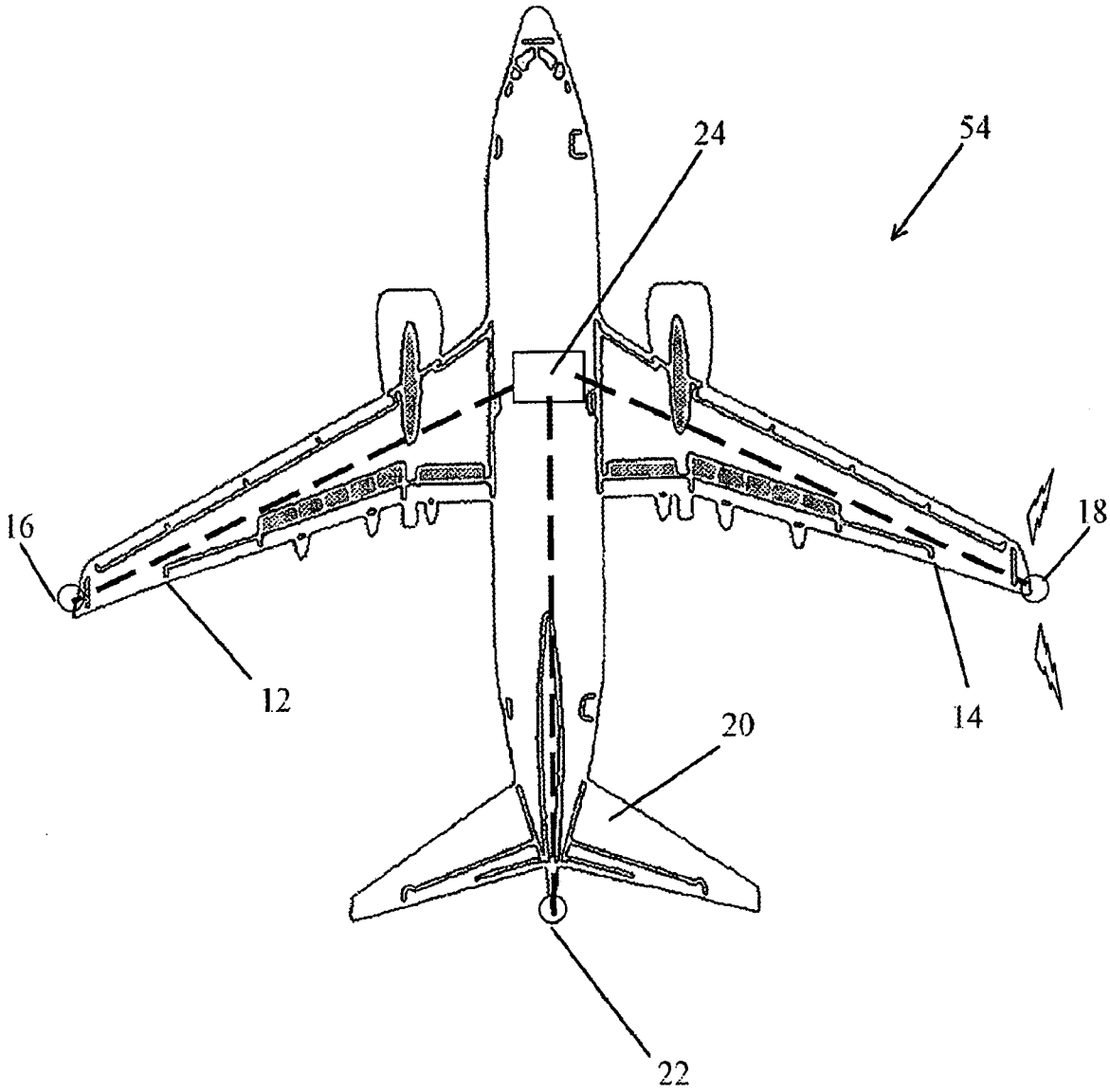
FIG. 9 is a top view of an aircraft incorporating the tactical integrated illumination countermeasure system.

FIG. 9 illustrates a top view of an aircraft 54. On each wingtip 12, 14 of the aircraft 54 is the standard beacon 16, 18. On the tail tip 20, another standard beacon 22 is disposed. As indicated above, the control system 24 is electrically coupled to the lighting system of the aircraft 54. In this embodiment, only one beacon 18 is illuminated. In this embodiment, the one beacon 18 may contain one or multiple sources which can emit both visible and IR or ultra-violet light. A one beacon system will direct an incoming missile in the direction of the "walking centroid" off the engine. As the missile closes in on the aircraft, the walking centroid effect will direct the missile away from the engines and aircraft.

The present invention is inclusive of multi-band IR radiation beacons. While contemporary threats are generally expected to be in the short and medium IR range, the present invention extends to long wave infrared and ultraviolet wavelengths as well, where new and evolving threats can be expected to materialize.

The preferred embodiment for the countermeasure lamps and flash pattern is the Band 1 and Band 4 infrared seekers. It is also contemplated for the present invention to be used to counter missiles that home on any signature in the electromagnetic band since the present invention "spoofs" the proportional navigation control and does not rely on jamming a particular type of seeker. Lamps or electromagnetic emitters can be utilized to counter missiles that home on radar signatures, visible light, ultraviolet light, or any other part of the electromagnetic spectrum.

Although not necessary, the present invention can be integrated with an onboard missile detection system or connected to airborne communications equipment receiving signals from remote missile detection systems, whether aerial, ground, or sea based, for receiving real time information for automated or manual actuation, modification, or reconfiguration of the deceptive signature broadcast system operating parameters.

The present invention may emit a deceptive signature omni-directionally, directionally, or bi-directionally, and have directionally independent phasing or common field of view phasing between lighting assemblies.

The deceptive signature pattern broadcast system remains active and functioning during periods or places of vulnerability. In the above embodiments, there is no need for detection capability on board or associated with the host platform. However, the system can be utilized in conjunction with a detection system to become an active, rather than a passive, system. For example, the countermeasure system may be automatically activated by an onboard missile warning system when a missile is detected within a certain range of the asset (i.e., about 100 feet to about 20,000 feet). It is understood that missile warning systems improve with the application of new technology; therefore, the present invention encompasses the ability to detect incoming missiles from a variety of ranges of the asset. Likewise, the countermeasure system may be automatically activated when the altimeter decreases below a certain value (i.e., the aircraft is flying below about 15,000 feet to about 20,000). It is understood that missile effective ranges improve with the application of new technology; therefore, the present invention encompasses the ability to activate at higher altitudes.

All types of threat vehicles are contemplated, including land-based, stationary, seaborne, undersea and outer space mediums, and host assets. The threat vehicles include aircraft, missiles, land and sea surface borne vehicles, and torpedoes.

Although aircraft are illustrated in the above examples, other assets are contemplated. The above embodiments of the present invention extend to protective systems for airplanes, helicopters, ships, tanks, trucks, amphibious vehicles, reentry space vehicles including ballistic missiles, and even to stationary targets such as sea-based oil rigs, power plants, pumping stations, and any mobile or fixed asset for which some type of signature quality or targetable electromagnetic emissions is a necessary byproduct of its normal functionality.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention.

What is claimed is:

1. A method for generating visible light and a deceptive signature pattern for an emissions producing asset comprising:

illuminating at least one lighting assembly of an existing lighting system of the asset in a pattern, said at least one lighting assembly producing visible light synchronous with a signature of a wavelength in a substantially similar range as normal emissions of the asset;

modulating a radiant intensity of said signature of said at least one lighting assembly between a minimum radiant intensity and a maximum radiant intensity in a repetitive cycle to create said pattern; and operating a controller to regulate said pattern.

2. The method of claim 1, wherein:

said maximum radiant intensity is greater than a normal radiant intensity of the asset; and said minimum radiant intensity is at least equal to said normal radiant intensity of the asset.

3. The method of claim 1, wherein a range of said radiant intensity of said signature is about 0.1 to about 0.9 times a radiant intensity of the asset.

4. The method of claim 1, wherein a centroid of said radiant intensity of said signature and a radiant intensity of said asset during each said repetitive cycle moves uniformly from a first of said at least one lighting assembly to a last of said at least one lighting assembly.

5. The method of claim 1, wherein said modulating said radiant intensity comprises modulating said radiant intensity of a first of said at least one lighting assembly from said maximum radiant intensity to said minimum radiant intensity and concurrently modulating said radiant intensity of a next adjacent said at least one lighting assembly from said minimum radiant intensity to said maximum radiant intensity.

6. The method of claim 1, wherein the asset is selected from the group consisting of an airborne vehicle, a space vehicle, a landborne vehicle, a waterborne vehicle, an amphibious vehicle, and a stationary asset.

7. The method of claim 1, wherein a centroid of said radiant intensity of said signature and a radiant intensity of the asset during each said repetitive cycle moves uniformly across the asset.

8. The method of claim 1, wherein said wavelength comprises wavelengths within ultraviolet range through long wave infrared range.

9. The method of claim 1, wherein said repetitive cycle comprises a modulation time of about 0.1 to about 3 seconds.

10. The method of claim 1, wherein said repetitive cycle comprises a period of said maximum radiant intensity followed by a period of a lower radiant intensity followed by a snapback to said maximum radiant intensity.

11. The method of claim 10, wherein a time of said snap back is about 1 millisecond to about 200 milliseconds.

12. The method of claim 1, wherein said at least one lighting assembly is disposed on at least one of a wing tip, a tail tip, a belly, and a nose of the asset.

13. The method of claim 1, wherein said at least one lighting assembly has more than one illumination source.

14. The method of claim 1, wherein said illuminating said at least one lighting assembly is automatically activated when an altimeter of the asset decreases below about 15,000 feet to about 20,000 feet.

15. A system for altering the radiation signature pattern of an emissions producing asset comprising:

an existing lighting system of the asset having at least one lighting assembly, said at least one lighting assembly illuminates in a pattern to produce visible light synchronous with a signature of a wavelength in a substantially similar range as normal emissions of the asset;

a modulation means to modulate a radiant intensity of said signature of said at least one lighting assembly between a minimum radiant intensity and a maximum radiant intensity in a repetitive cycle to create said pattern; and a controller to operate said at least one lighting assembly in said pattern.

16. The system of claim 15, wherein:

said maximum radiant intensity is greater than a normal radiant intensity of the asset; and said minimum radiant intensity is at least equal to said normal radiant intensity of the asset.

17. The system of claim 15, wherein a centroid of said radiant intensity of said signature during said repetitive cycle moves uniformly from a first of said at least one lighting assembly to a last of said at least one lighting assembly.

18. The system of claim 15, wherein said modulation means modulates said radiant intensity of a first of said at least one lighting assembly from said maximum radiant intensity to said minimum radiant intensity and concurrently modulates said radiant intensity of a next adjacent said at least one lighting assembly from said minimum radiant intensity to said maximum radiant intensity.

19. The system of claim 15, wherein the asset is selected from the group consisting of an airborne vehicle, a space vehicle, a landborne vehicle, a waterborne vehicle, an amphibious vehicle, and a stationary asset.

20. The system of claim 15, wherein a centroid of said radiant intensity of said signature and a radiant intensity of the asset during each said repetitive cycle moves uniformly across the asset.

21. The system of claim 15, wherein said wavelength comprises wavelengths within ultraviolet range through long wave infrared range.

22. The system of claim 15, wherein said repetitive cycle comprises a modulation time of about 0.1 to about 3 seconds.

23. The system of claim 15, wherein said repetitive cycle comprises a period of said maximum radiant intensity followed by a period of a lower radiant intensity followed by a snapback to said maximum radiant intensity.

24. The system of claim 23, wherein a time of said snap back is about 1 millisecond to about 200 milliseconds.

25. The system of claim 15, wherein said at least one lighting assembly is disposed on at least one of a wing tip, a tail tip, a belly, and a nose of the asset.

26. The system of claim 15, wherein said at least one lighting assembly has more than one illumination source.

27. The system of claim 15, further comprising:

an activation means that automatically activates said pattern when an altimeter of the asset decreases below about 15,000 feet to about 20,000 feet.

28. The system of claim 15, wherein said radiant intensity of said signature is about 0.1 to about 0.9 times a radiant intensity of the asset.

29. A method for generating visible light and a deceptive signature pattern for an emissions producing asset comprising:

illuminating at least one lighting assembly of an existing lighting system of the asset in a pattern, said at least one lighting assembly producing visible light synchronous with a signature of a wavelength in a substantially similar range as normal emissions of the asset;

modulating a radiant intensity of said signature of said at least one lighting assembly between a minimum radiant intensity and a maximum radiant intensity in a repetitive cycle to create said pattern, said radiant intensity of said signature is about 0.1 to about 0.9 times a normal radiant intensity of the asset; and operating a controller to regulate said pattern.

* * * * *